US006035535A

United States Patent [19]

Dischler

[11] Patent Number: 6,035,535

[45] Date of Patent: Mar. 14, 2000

[54] FLEXIBLE SAFETY RAZOR HEAD WITH INTRINSICALLY FENCED CANTILEVERED CUTTING EDGES

[76] Inventor: Louis Dischler, 252 W. Park Dr. Duncan Park, Spartanburg, S.C. 29306-5013

[21] Appl. No.: 09/164,837

[22] Filed: Oct. 1, 1998

[51] Int. Cl.[7] ..... B26B 21/16; B26B 21/22

[52] U.S. Cl. ..... 30/48; 30/50

[58] Field of Search ..... 30/47, 48, 50, 30/526–532, 49

[56] References Cited

U.S. PATENT DOCUMENTS

| | | | |
|---|---|---|---|
| 228,829 | 6/1880 | Moody . | |
| 1,035,548 | 8/1912 | Dickenson . | |
| 1,241,921 | 10/1917 | Carroll . | |
| 1,308,730 | 7/1919 | Benn | 30/531 X |
| 1,387,465 | 9/1921 | Browning . | |
| 1,598,130 | 8/1926 | Greef | 30/532 X |
| 1,945,117 | 1/1934 | Mann | 30/531 |
| 2,126,728 | 8/1938 | Buell | 30/48 |
| 3,263,330 | 8/1966 | Ferrara . | |
| 3,505,734 | 4/1970 | Iten . | |
| 3,750,285 | 8/1973 | Michelson . | |
| 3,964,160 | 6/1976 | Gordon . | |
| 4,252,837 | 2/1981 | Auton . | |
| 4,443,939 | 4/1984 | Motta . | |
| 4,663,843 | 5/1987 | Savage . | |
| 4,720,917 | 1/1988 | Solow | 30/49 |
| 4,754,548 | 7/1988 | Solow . | |
| 4,854,043 | 8/1989 | Chen . | |
| 4,914,817 | 4/1990 | Galligan et al. . | |
| 4,976,028 | 12/1990 | Chen . | |
| 5,031,316 | 7/1991 | Oldroyd | 30/47 |
| 5,182,858 | 2/1993 | Chen . | |
| 5,199,173 | 4/1993 | Hegemann et al. | 30/531 X |
| 5,388,332 | 2/1995 | Oldroyd | 30/49 X |
| 5,526,568 | 6/1996 | Copelan . | |
| 5,689,883 | 11/1997 | Ortiz et al. | 30/50 X |

OTHER PUBLICATIONS

U.S. application No. 09/102,138, Dischler, filed Jun. 22, 1998.

*Primary Examiner*—Douglas D. Watts

[57] ABSTRACT

The various embodiments of the invention are directed to segmented safety razor heads (10) having intrinsically fenced cantilever mounted blade assemblies (15) mounted to the segments at a high slicing angle to the shaving direction (50). Each segment (70) is hinged to adjacent segment to allow convex and concave bending. Alternatively, blade assemblies (15) may be joined together by means of an elastic ligature (74). Two point mounting to a handle (12) allows convex and concave bending. Mounting may be facilitated with magnetic cups (138) attached to the handle, and mating buttons (132) attached to the read of the razor head.

19 Claims, 5 Drawing Sheets

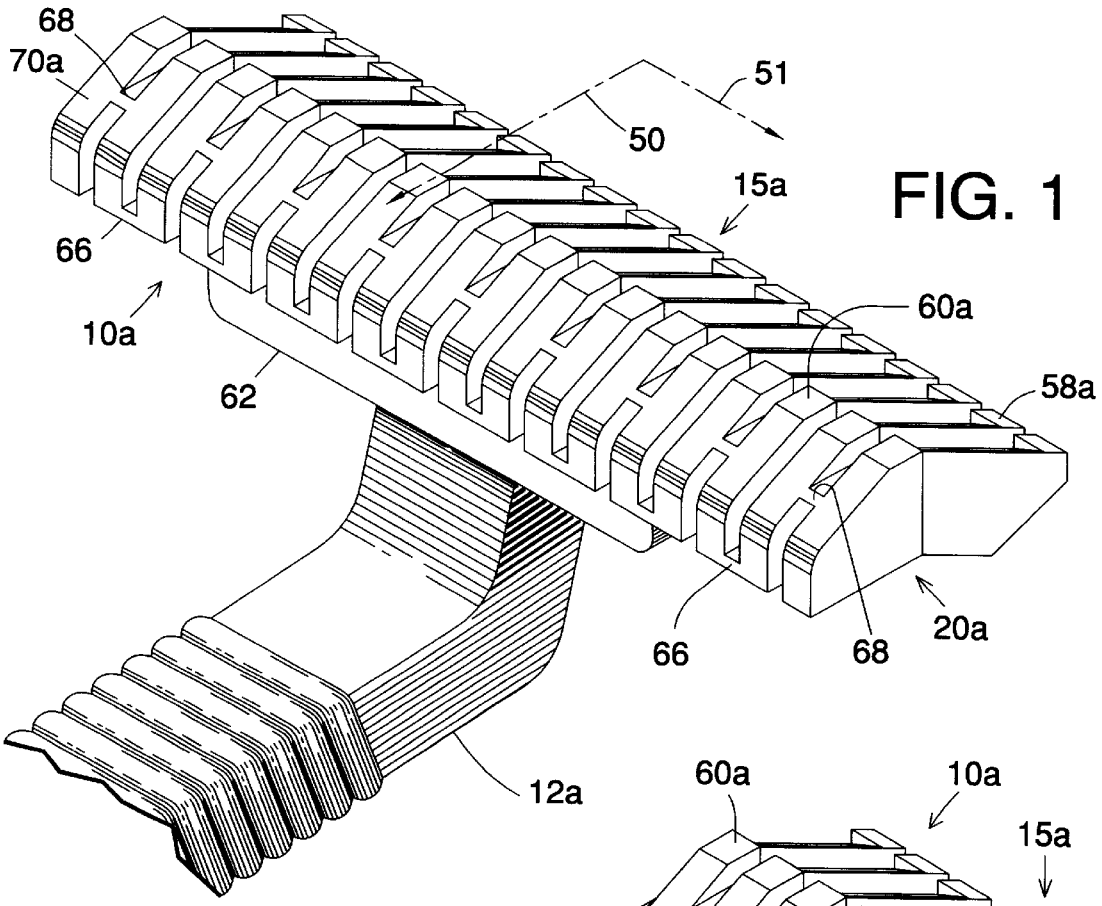
FIG. 1
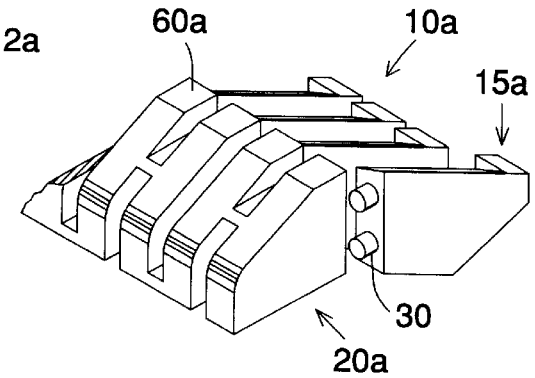
FIG. 2
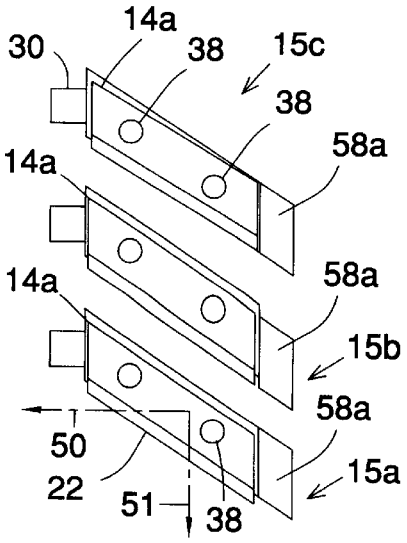
FIG. 3C
FIG. 3B
FIG. 3A

FIG. 11B
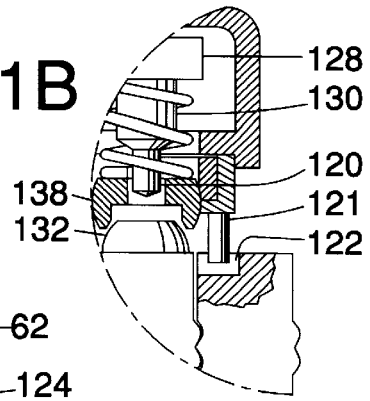
FIG. 11A
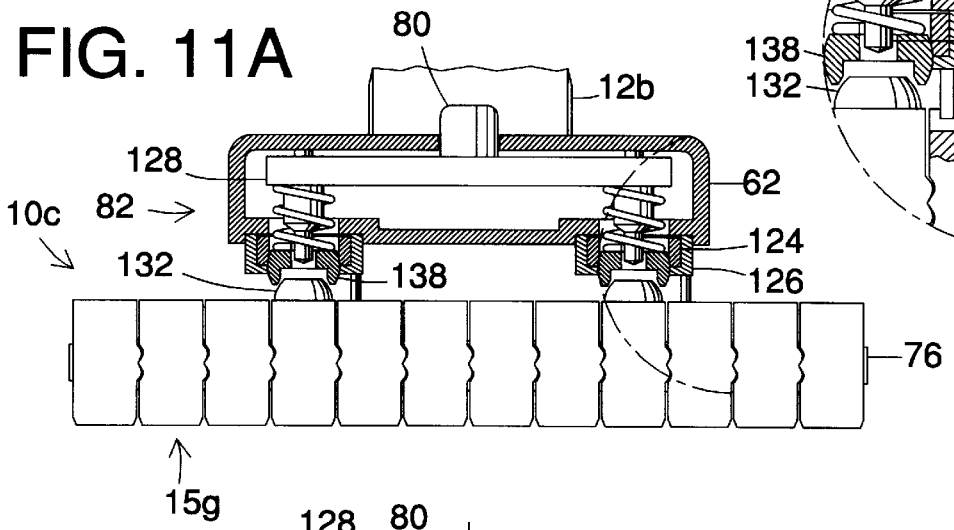
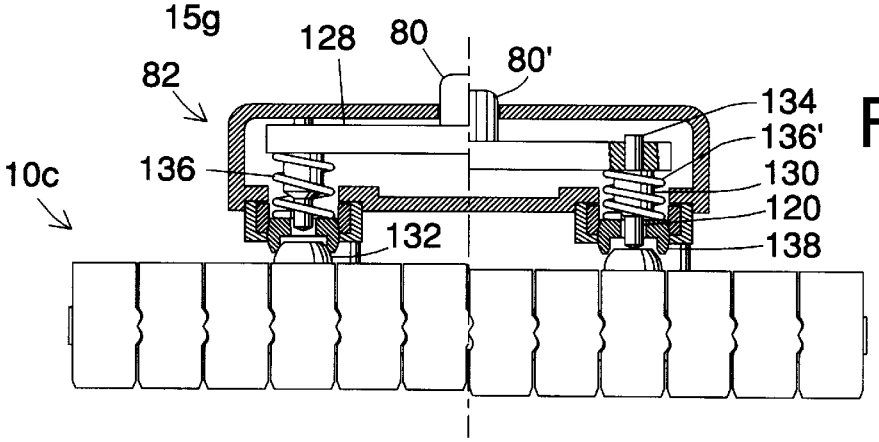
FIG. 12
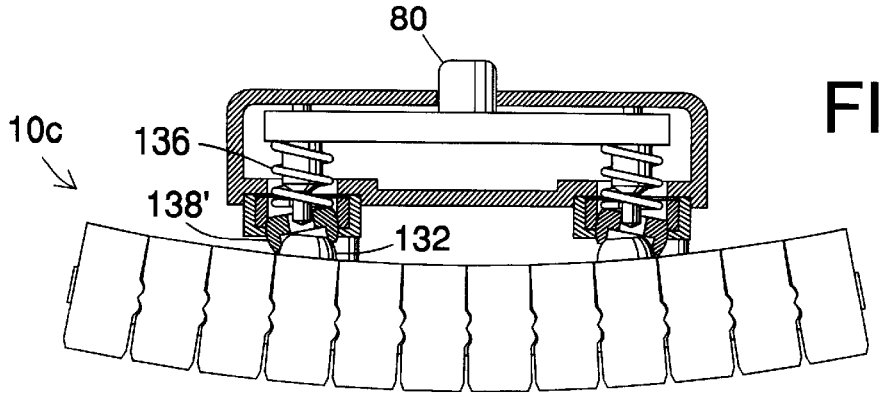
FIG. 13

FLEXIBLE SAFETY RAZOR HEAD WITH INTRINSICALLY FENCED CANTILEVERED CUTTING EDGES

FIELD OF THE INVENTION

This invention relates to flexible safety razors of the type that have a plurality of adjacently mounted blades permanently mounted in a segmented razor head. More particularly, this invention relates to razor heads having a plurality of cantilever blades having intrinsic fencing, mounted at a high slicing angle.

BACKGROUND OF THE INVENTION

The advantages of using blades with a slicing rather than chopping motion have been known for hundreds, perhaps thousands of years. One has but to cut a loaf of bread to immediately realize that a slicing motion cuts cleaner and with less tearing. The most immediate advantage for the blade is the reduction of force that is required for cutting, reducing wear and tear on the cutting edge. For a shaver, it is perhaps more important that the cutting force applied to the follicles be reduced, producing a less painful shaving experience. While it has been possible for the shaver to use straight razors, as well as disposable razor cartridges, in such a way as to create an oblique or slicing angle, this has always been hazardous, as the blade that easily slices follicles also easily slices the epidermis. Several patents have resulted from attempts to safely apply the advantages of a slicing angle to shaving. Gordon, (U.S. Pat. No. 3,964,160) and Copelan, (U.S. Pat. No. 5,526,568) patented razors which made manual oblique shaving easier, that is, the wrist did not have to be held at an awkward angle to maintain the slicing angle, but both lacked the concomitant stability of a razor head perpendicularly oriented to the shaving direction. Copeland teaches that, to obtain the advantages of oblique shaving while avoiding cutting of the skin, the oblique angle of a useable razor head should be restricted to between 10 and 26 degrees, and preferably to an angle of 18 degrees. Razors featuring adjustable slicing angles, such as Gordon's, have had an additional disadvantage, since the geometry of the razor head must be carefully balanced, and is unlikely to be optimum for variable slicing angles. Others have patented a variety of oblique arrangements, wherein a pair of blades are oriented in a "V" arrangement. Carroll (U.S. Pat. No. 1,241,921), Moody (U.S. Pat. No. 228,829), and Browning (U.S. Pat. No. 1,387,465) are typical of this approach, which suffers from excess stability. Because of the large footprint created by the two legs of the cutting zone, such a razor head has great difficulty in handling variations in facial geometry; a difficulty which only increases as the slicing angle, is increased. Savage (U.S. Pat. No. 4,663,843) patented a razor head using a conventional blade in tandem with blades angled at a slicing angle. He teaches that the slicing angle should lie between 15 and 30 degrees, in order to have some of the advantages of oblique cutting, while avoiding cutting of the skin. Savage does not appreciate the advantages arising from the use of intrinsic fencing, which would not only allow shaving at much higher slicing angles, but also make a tandem conventional blade unnecessary.

Fencing of razor blades is known. Dickenson (U.S. Pat. No. 1,035,548) teaches the use of wire wrapping of the blade edges, an approach that has been used by several others, such as Iten (U.S. Pat. No. 3,505,734), and Michelson (U.S. Pat. No. 3,750,285). Similarly, Ferrara (U.S. Pat. No. 3,263,330) discloses a fencing arrangement wherein the blade edge is wrapped with a flexible perforated sheet, and Auton (U.S. Pat. No. 4,252,837) patented a blade fenced with a vacuum deposited intermittent coating. Galligan et al. (U.S. Pat. No. 4,914,817) teaches the use of tape having parallel riblets covering parts of the blade edges.

Cantilever mounting of cutting blades is known. Straight razors and steak knives are to examples. However, none have previously appreciated the advantages accruing to cantilever mounting of intrinsically fenced blades.

Several razors have been patented which featured shaving heads designed to be dynamically flexible in response to various forces exerted during shaving. For example, in Solow, (U.S. Pat. No. 4,754,548), such a razor features a double row of segments equipped with blades, hinged together to allow bending of the razor head. Such a razor has a large footprint, and does not give complete coverage at the end of a stroke. Solow also proposes a single array of angled blade housings, independently mounted to a handle, which is depicted in FIG. 20. This approach suffers from two deficiencies: first, as the razor head is not a single cartridge, it is not easily replaceable, and second, the razor head is subject to considerable chatter, since each of the small razor heads is capable of vibrating relative to its neighbors.

Other examples of dynamic flexibility are found in a patent issued to Motta et al (U.S. Pat. No. 4,443,939). This razor head configuration discloses a razor cap having corrugated segments disposed on either side of the cap center as well as a guard bar which is individually segmented and a seat portion of the blade support structure from which the guard bar depends having a convoluted, cage-like structure. The spacer in this two-blade system has cut out areas to increase flexibility, and blades featuring extended longitudinal slots. Nevertheless, the blade support structure, the blades, the spacer, and the cap must all bend in response to shaving forces, greatly increasing the bending stiffness.

In Chen (U.S. Pat. Nos. 4,854,043 and 4,976,028), a flexible razor head is disclosed which is similar to that of Motta, in that the blade support structure, the blades, the spacer, and the cap must all bend in response to shaving forces.

Each of the razor systems wherein the razor head is moveable suffers from some disadvantage, either from excessive bending stiffness, as in the case of Chen and Motta, or from lack of restraint, as in the case of the single row razor of Solow. None take advantage of the controlled flexibility inherent in oblique cantilevered blades, according to the present invention.

OBJECT AND ADVANTAGES

Accordingly, I claim the following as objects and advantages of the invention: to provide a razor head having cantilever mounted, intrinsically fenced cutting means, oriented at a high shearing angle, which is capable of producing a smooth, safe shave with reduced pulling of follicles; to reduce chatter and vibration while shaving; to enhance the life of razor cutting means; to provide a clean trim line; to improve skin support and flow during shaving; to provide channels for improved flow of shaving debris; to provide improved interaction of shaving lubricant with the cutting edges; to provide a flexible razor head, capable of dynamically responding to shaving forces; and to provide a razor head which may be easily and correctly assembled with a handle.

Further objects and advantages will become readily apparent as the specification proceeds to describe the invention with reference to the accompanying drawings.

BRIEF DESCRIPTION OF THE DRAWINGS

The above as well as other objects of the invention will become more apparent from the following detailed description of the preferred embodiment of the invention, when taken together with the accompanying drawings in which:

FIG. 1 is a perspective view of a flexible razor head assembly with cantilever blade means, according to an embodiment of the invention.

FIG. 2 is a partial perspective view of the razor head assembly of FIG. 1.

FIG. 3A is a plan view of a blade assembly taken from the razor head shown in FIG. 1.

FIG. 3B is a plan view of a variant of the blade assembly shown in FIG. 3A.

FIG. 3C is a plan view of a variant of the blade assembly shown in FIG. 3A.

FIG. 11A is a front elevation showing two point mounting of the razor head.

FIG. 11B is an enlarged view of the circled area of FIG. 11A.

FIG. 12 is a front elevation showing the razor head of FIG. 11A before and after release.

FIG. 13 is a front elevation showing bending of the razor head of FIG. 11A.

DRAWING REFERENCE NUMERALS

Figure 4:
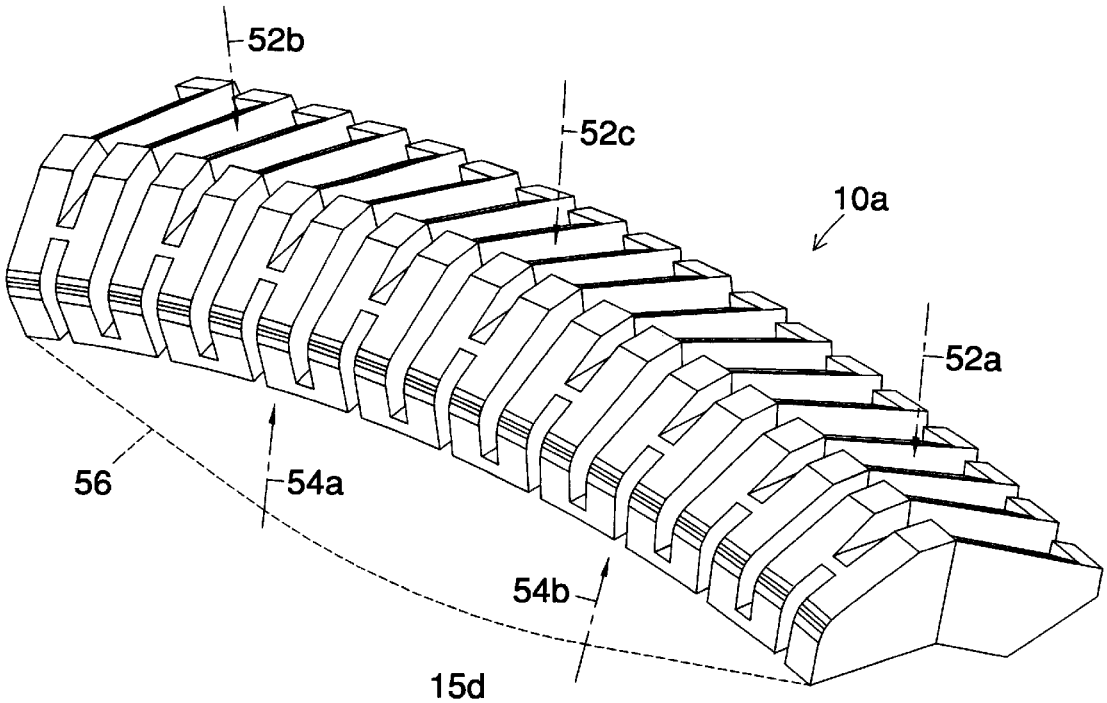
FIG. 4 is a perspective view of a flexible razor head assembly of FIG. 1, in four point bending.

| | |
|---|---|
| 10 | razor head assembly |
| 12 | handle |
| 14 | blade |
| 15 | blade assembly |
| 16 | fencing element |
| 20 | flexible base |
| 22 | cutting edge |
| 30 | attachment post |
| 31 | mounting tab |
| 36 | flanking guard |
| 38 | rivet |
| 50 | shaving direction |
| 51 | trim direction |
| 52 | load direction |
| 54 | reaction load direction |
| 56 | concave bend line |
| 58 | trailing guard |
| 60 | leading guard |
| 61 | slot |
| 62 | support housing |
| 64 | bridge |
| 66 | lower bridge |
| 67 | bend line |

-continued

| | |
|---|---|
| 68 | upper bridge |
| 70 | segments |
| 72 | channel |
| 73 | rod |
| 74 | ligature |
| 75 | ligature |
| 76 | anchor |
| 78 | slot |
| 79 | chamfer |
| 80 | release button |
| 82 | support assembly |
| 96 | rocker face |
| 98 | rocker land |
| 102 | pivot corner |
| 106 | lower radius |
| 108 | upper radius |
| 110 | chamfer |
| 112 | pivot |
| 114 | recess |
| 116 | locating knuckle |
| 118 | groove |
| 120 | pin |
| 121 | pin |
| 122 | recess |
| 124 | top bearing |
| 126 | lower bearing |
| 128 | ejection bar |
| 130 | ejection cylinder |
| 132 | button |
| 134 | post |
| 136 | spring |
| 138 | cup |

DETAILED DESCRIPTION OF THE INVENTION

Specific terms are used as follows: "Shaving plane" means the ideally flat skin surface to be shaved. "Safety razor" means a razor having a leading guard, which is typically used with a lather or cream. "Razor head" is meant to include both razor cartridges adapted for use with a separate handle, as well as the upper, operative elements of a disposable razor with a permanently attached handle. "Shaving direction" signifies the direction in the shaving plane in which the razor head is intended to be moved. "Trim direction" signifies the direction in the shaving plane generally perpendicular to the shaving direction, that is, the direction taken when the razor head is moved sideways. "Cutting zone" refers to that area of the razor head containing blades, which is designed to cut follicles. The cutting zone has a width, which is generally perpendicular to the shaving direction, and a height considerably shorter than the width. "Span" means the distance between two adjacent edges in the cutting zone, measured in the shaving direction. "Leading span" means the span between the leading guard and the first encountered blade edge. "Trailing span" means the span between the trailing guard and the immediately preceding blade edge, while "intermediate span" means the span between two adjacent cutting edges. "Blade spacing" refers to the distance between two adjacent cutting edges measured in the direction perpendicular to the shaving direction. "Cantilever mounting" of a blade means that the blade is mounted from one of the blade ends adjacent to the blade cutting edge. "Fencing" refers to any method of intermittently and positively breaking the contact of a blade edge with the skin, so that a long blade edge is effectively broken up into a series of shorter blade edges. "Effective cutting length" means the uninterrupted cutting edge, bounded by guards or fencing elements, which can contact the skin. "Shaving angle" is the angle the blades make relative to the shaving plane. "Slicing angle" is the angle in the shaving plane that the blade edges make relative to the trim direction. "Trim angle" is the angle in the shaving plane that the blade edges make relative to the shaving direction. "Guard" refers to one of the generally peripheral ridges that control the contact of the razor edges with the skin. "Leading guard" means the guard extending along the width of the cutting zone, which contacts the skin prior to the blades. "Trailing guard" means the guard extending along the width of the cutting zone, which contacts the skin subsequent to the blades, and "flanking guard" means the guard that keeps the skin from contacting the blade edge along the height of the cutting zone. The guards need not be continuous.

PRINCIPLE OF THE INVENTION

The genesis of this invention began with the observation that fencing was effective even at high slicing angles, coupled with the realization that short sections of blades, bounded by leading and trailing guards, were functionally superior to single short blade segments between fencing elements.

An investigation was conducted to examine the relationship of slicing angle to perceived roughness, as it was expected that the sensation of roughness, as it reflects the tendency of the cutting edge to grab and release small protrusions on the surface, would provide a measure of the tendency of the blade to cut into the epidermis. A randomly textured rubber surface was used to simulate rough skin. A razor blade edge, oriented at a 90 degree shaving angle in order to eliminate the propensity to cut into the simulated skin, was loaded to simulate a light shaving pressure, and was pulled across the surface at various slicing angles. A measure of the subjective sensation of roughness was then created by force ranking the trial results obtained with a full width blade using slicing angles from 0 to 80 degrees, at 10-degree increments. This ranking runs from 1 to 9, with larger numbers indicating increasing roughness. The results appear in the column for the 39-mm length in the table below. The perceived roughness tended to increase steadily from 0 degrees to 80 degrees, with a small dip occurring at 10 degrees. The effective blade width was then reduced by partially covering the blade edge with thin metal tape. The trial was then repeated as before, this time rating the perceived roughness relative to the 9 level scale developed using the full width (39 mm) blade.

As the effective blade length was incrementally reduced, an unexpected inversion of the trend to increasing roughness was observed to occur at lengths of 8 mm and below, which is contrary to the teachings of others versed in the art. At 8 mm, the inversion occurs at 40 to 50 degrees, and at 6.5 and 4.5 mm, the inversion occurs at 30 degrees. The inversion is more pronounced at 6.5 mm and below, where the perceived roughness plummets to the lowest levels on the scale. Surprisingly, the best results were obtained at angles greater than 50 degrees. To investigate the effect of the total exposed blade length, another test was run with a blade fenced in 2 places to provide three lengths of exposed blade, each 4.5 mm long, which produced almost identical results to that tabulated for a single 4.5 mm section in the table below, indicating that this discovered effect is not due to a reduction in the total length of the exposed blade.

TABLE

| | | Length of exposed blade edge (mm) | | | | | |
|---|---|---|---|---|---|---|---|
| | | 39 | 11 | 9.5 | 8 | 6.5 | 4.5 |
| Slicing angle (degrees) | 0 | 3 | 2 | 3 | 2 | 2 | 3 |
| | 10 | 1 | 1 | 1 | 1 | 1 | 1 |
| | 20 | 2 | 2 | 2 | 2 | 3 | 2 |
| | 30 | 4 | 3 | 2 | 2 | 4 | 3 |
| | 40 | 5 | 4 | 2 | 3 | 3 | 2 |
| | 50 | 6 | 4 | 3 | 3 | 2 | 2 |
| | 60 | 7 | 4 | 5 | 2 | 1 | 1 |
| | 70 | 8 | 5 | 5 | 2 | 1 | 1 |
| | 80 | 9 | 6 | 5 | 2 | 1 | 1 |

Shaving tests were performed using a conventional two-blade cartridge razor fenced to provide multiple exposed blade lengths corresponding to the blade lengths used in the Table above. It was found that expose blade lengths of 9.5 mm and greater tended to cut the skin at slicing angles above 30 degrees. Using an exposed blade length of 8 mm produced a smooth shave at various shearing angles up to 85 degrees 85 degrees, with no noticeable cutting. However, several hours later, some reddening was observed, indicating that cutting of the epidermis did occur. For exposed lengths of 6.5 mm and below, no cutting or delayed skin response was observed at any slicing angle. Pulling of follicles during shaving was noticeably reduced at angles greater than 30 degrees, and this was particularly noticeable at angles greater than 45 degrees. Subsequent tests were performed using nine short blades arranged in a staggered relationship, and guarded with leading and trailing guards. Using blade lengths of 6.5 mm, and a slicing angle of 45 degrees, it was apparent that the same benefits of enchanced follicle cutting resulted, while at the same time epidermal damage was avoided, as was predicted from the previous tests. This general arrangement of short blades with leading and trailing guards at a high slicing angle is herein referred to as "intrinsic fencing". The "high slicing angle" should be more than 30 degrees, preferably at least 45 degrees and most preferably at least 50 degrees. To control the flow of skin so that contact with the blades is limited to the effective blade length, the leading and trailing guards should rise approximately to the level of the cuttings. The guards may also rise above this level, reducing the effective blade length, and may comprise skin tensioning means. Intrinsic fencing is superior to wire or thread fencing, which can break or become dislodged during use, and can trap or impede shaving debris.

For razor heads employing cutting edges at a slicing angle, skin flow control using short blade segments between leading and trailing guards is superior to that obtained by point fencing of the blades, such as that obtained by forming deposits on the blade edge. With leading and trailing guards, the skin is supported in the blade direction by the several blades, and also in the guard direction, while the skin can bulge further into the spaces between the blades when point fencing is used.

The arrangement of blades in the instant invention produces a variable span—a leading span which ranges from zero to the intermediate span, which is constant, and a trailing span, which ranges from the intermediate span to zero. To control the intermediate span so as to produce a smooth and continuous shave, the blade spacing should not exceed the effective blade length multiplied by the cosine of the slicing angle. Also, it is believed that the minimum effective blade length is about 1 mm, in order to provide sufficient cutting action.

In order to produce a clean trim line, the shaver may move the razor head of the instant invention against the skin in the trim direction. If, for instance, the blades are set at a slicing angle of 45 degrees, then the trim angle is also 45 degrees. As the slicing and trim directions are orthogonal, the slicing angle plus the trim angle equal 90 degrees. Trimming a clean line next to a mustache can be accomplished by moving the razor head down the face to the edge of the mustache, then moving the razor head sideways along the edge of the mustache. When moved sideways, the cutting means are arranged one behind the other. This not only produces a sharp trim line, but cuts the follicles many times over in one pass, so as to produce an unusually close shave. The razor head of the instant invention thus has two modes of operation, shaving and trimming, which in general can be accomplished without twisting the razor head or the wrist, but is accomplished simply by changing the direction of the stroke by 90 degrees.

Cantilever mounting of a plurality of cutting elements makes possible an unusually flexible razor head, since the blades are not themselves forced to bend to accommodate the distortions of the razor head in response to shaving forces, and the bending stiffness of the blades does not therefore add to the overall stiffness of the razor head. Cantilever mounting also allows non-helical bending of the razor head when the blades are mounted to segments oriented in a linear array, and hinged so as to bend about an axis parallel to the shaving direction. The open construction of cantilever mounting allows debris to readily exit from the rear of the razor head, while the oblique angle associated with intrinsic fencing allows shaving lubricant to flow down the blade before it is scraped from the skin.

DESCRIPTION OF THE PREFERRED EMBODIMENTS

Turning now to the figures, wherein like reference numbers designate similar components throughout the various views, FIG. 1, illustrates a flexible razor head assembly 10*a* mounted to support means enclosed within a support housing 62, which is in turn attached to a supporting handle 12*a*. The razor head assembly 10*a* has a plurality of blade assemblies 15*a*, cantilever mounted to the flexible base 20*a*. The blade assemblies 15*a* are shown to be oriented at a high slicing angle to the base 20*a*, the long direction of which is oriented parallel to the trim direction 51, and perpendicular to the shaving direction 50. The flexible razor head 10*a* comprises segments 70*a*, which are alternately joined by lower bridges 66 and upper bridges 68. Alternation of upper and lower bridges is preferred; however variations are possible to produce blades which are relatively stiff in certain areas and relatively flexible in others. For instance, bridges at the same level may connect adjacent segments 70*a* in order to increase the local bending stiffness of the base 20*a*. The use of upper and lower brides also confers a reduced compressive stiffness of the base 20*a* relative to the trim direction 51, further enhancing the flexibility of the razor head assembly 10*a*. The base 20*a* carries a plurality of leading guard segments 60*a*, and the blade assemblies 15*a* carry the trailing guards 58*a*. The support housing 62 is preferably attached at two points (not shown) to the lower surface of the base 20*a*.

In FIG. 2, a portion of the razor head 10*a* of FIG. 1 is shown, to illustrate the connective relationship of the blade assembly 15*a* with the base 20*a*. The blade assemblies 15*a* are joined by means of attachment posts 30 which mate with corresponding holes (not shown) in the rear of the base 20*a*. The leading guard 60*a* may optionally be partially or wholly incorporated into the blade assembly 15*a*.

In FIGS. 3A, 3B and 3C, the blades 14*a* are shown to be attached to the upper surface of the blade assemblies 15*a*, 15*b*, and 15*c* by means of rivets 38. The blades 14*a* may optionally be attached by means of adhesive, or by enclosing part of the blades into the assembly 15*a* by the process of insert molding. In order to achieve adequate guarding of the trailing part of the cutting edge 22 of the blade 14*a*, the trailing guard 58*a*, shown in FIG. 3A, is at the same level as, or raised slightly above the cutting edge 22. In FIG. 3B, the trailing guard 58*a* is shown to be moved forward, leading the cutting edge 22, and in FIG. 3C, the blade 14*a* is shown to placed on the upper surface of the assembly 15*c* in a skewed fashion, so that the trailing part of cutting edge 22 of the blade 14*a*, that part closing to the guard 58*a*, is retracted relative to the leading edge of the blade 14*a*.

Bending of the razor head 10*a* when contacting a concave surface is illustrated in FIG. 4. When the razor head 10*a*, originally in a flat configuration, contacts a concave skin surface (not shown), loads are produced on the razor head 10*a* by the concave skin surface which may be resolved into components in the directions 52*a* and 52*b*, also producing reaction forces at the mounting points connecting the razor handle (not shown) to the razor head 10*a*. These reaction forces are shown directed through the mounting points along lines 54*a* and 54*b*, which in combination with the force components in directions 52*a* and 52*b*, produce a bending moment on the razor head 10*a*. If the razor head contacts a convex skin surface (not shown), then the primary component of force generated by contact with the skin will lie generally along line 52*c*, with reaction forces again along lines 54*a* and 54*b*. This combination of forces produces a bending moment which forces the razor head 10*a* to bend in the opposite direction, illustrated by the dashed concave bend line 56. It is preferred that the razor head be mounted at points which lie away from the distal ends of the razor head 10*a* so that the reaction forces may cooperate with primary forces directed along either line 52*c*, or 52*a* and 52*b*, thereby producing bending moments which urge the razor head 10*a* into either concave or convex shapes, matching the corresponding convex or concave skin surfaces. For two point support of the razor head, it is preferred that each support be located at a distance from each distal end of the razor head of between 5% and 40% of the total width of the razor head, and more preferably at a distance of between 10% and 35% of the total width, in order that both three and four point bending be achieved.

Figure 5:
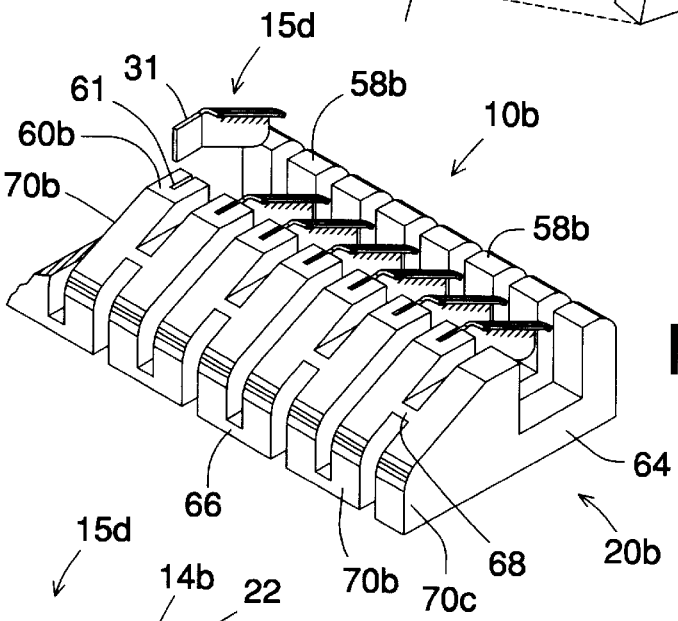
FIG. 5 is a partial perspective view of a variant of the razor assembly shown in FIG. 1.

FIG. 5 illustrates an alternative construction of a flexible razor head 10*b*, wherein the flexible base 20*b* carries both leading guards 60*b* and trailing guards 58*b*, connected by bridge 64. The blade assembly 15*d* is mounted in slots 61 in the segments 70*b*. Not all of the segments need carry blades, for instance, the last segment 70*c* may be left blank, as otherwise the blade assembly 15*d* mounted to this segment would project from the side of the razor head 10*b*.

Figure 6:
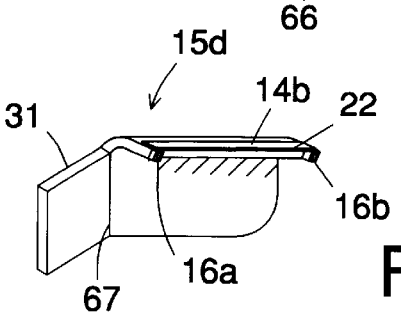
FIG. 6 is an enlarged perspective view of a blade assembly in FIG. 5.

In FIG. 6, an enlarged view of the blade assembly 15*d* is shown. The mounting tab 31 is bent along line 67 relative to the rest of the assembly through an angle equal to 90 degrees minus the slicing angle. The blade 14*b* is fixed to the upper surface of the blade assembly 15*d*, which is bent down from the vertical by an angle equal to 90 degrees minus the shaving angle. The sides of the blade land may comprise fencing elements 16*a* and 16*b*, which may be used alone, serving as leading and trailing guards respectively, or may serve to complement the guards 60*b* and 58*b* as shown in FIG. 5. Additional fencing elements (not shown) may be incorporated between fencing elements 16*a* and 16*b*, in order that longer blades may be used.

Figure 7:
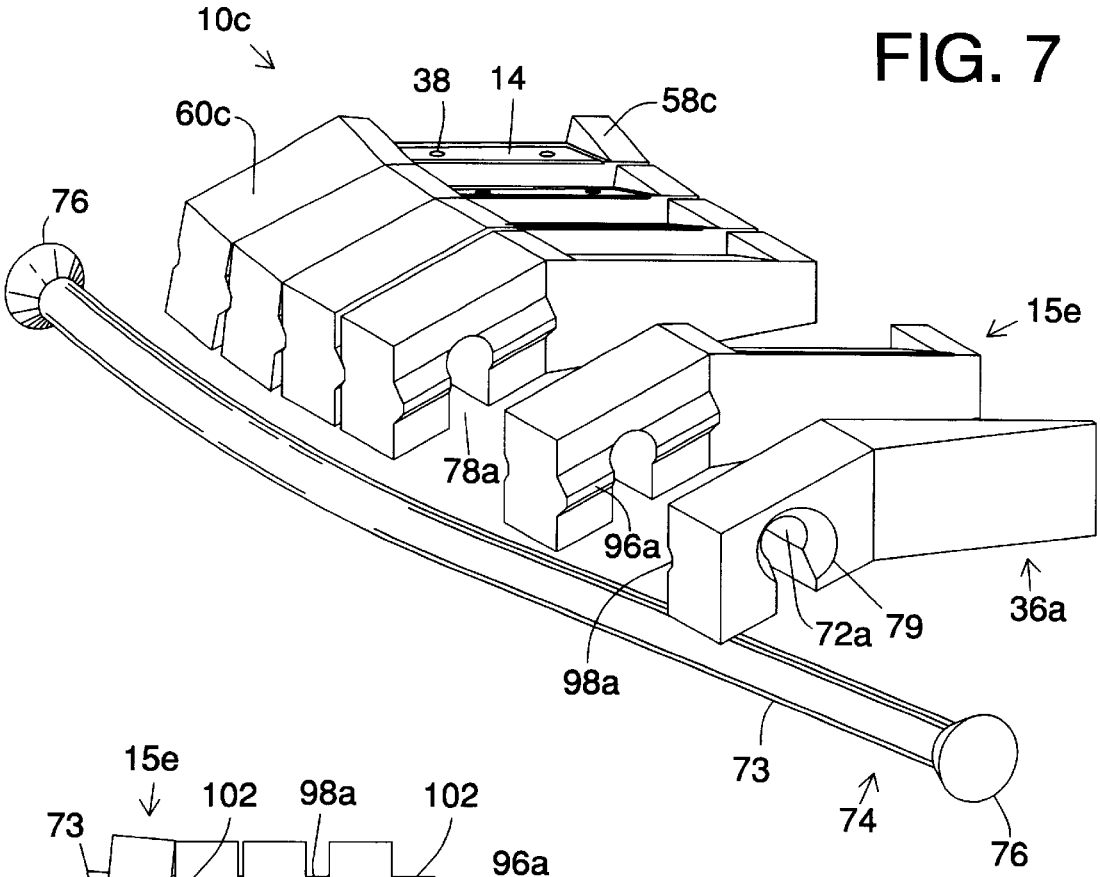
FIG. 7 is an exploded perspective view of a flexible segmented razor head with cantilever elements.

In FIG. 7, a variation of a flexible razor head 10*c* is shown in an exploded view, which comprises a plurality of separable blade housings 15*e*, joined together in a compressive relationship by an elastic ligature 74, which is preferably of a rubber or elastomeric material. The ligature 74 comprises a central flexible section, shown in FIG. 7 as a rod 73, with anchors 76 at the distal ends, mating with chamfers 79. The diameter of the rod 73 is reduced by tensile loading during assembly, allowing the rod 73 to slip into the slots 78*a* of the blade assemblies 15*e*, and thence into the channels 72*a*. With a full complement of blade assemblies 15*e* in place (optionally including flanking guard 36*a* ) the tension on the ligature 74 is released, allowing the diameter of the rod 73 to expand so that it is trapped by the relatively narrower slot 78*a*. The stacked length of the blade assemblies 15*e* and optional flanking guard 36*a* is preferably longer than the length of the rod 73, so that the rod maintains a residual tension, compressively loading the razor head assembly 10*c*, with bending of the razor head controlled by pivotal contact between adjacent areas of the blade housings 15*e*.

Figure 8A:
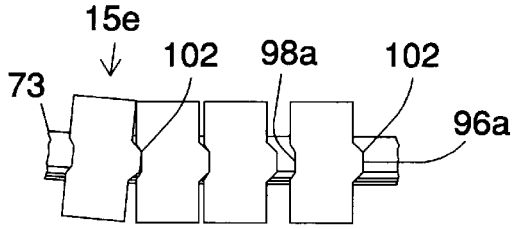
FIG. 8A is a partial front elevation of the segmented razor head shown in FIG. 7.
Figure 8B:
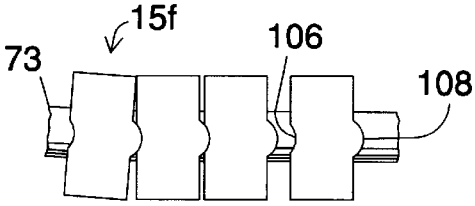
FIG. 8B is a partial front elevation of a variant of the segmented razor head shown in FIG. 7.
Figure 8C:
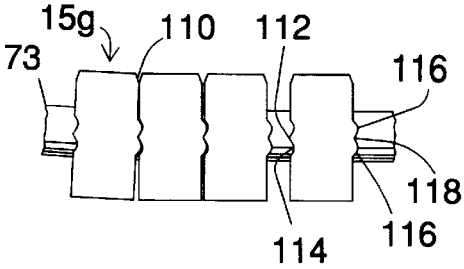
FIG. 8C is a partial front elevation of a variant of the segmented razor head shown in FIG. 7.

In FIGS. 8A, 8B, and 8C, three types of pivotal contact are shown. In FIG. 8A, as in FIG. 7, contact is between the rocker face 96*a* and the rocker land 98*a* of the adjacent segment 15*e*. Pivoting of one blade assembly 15*e* relative to an adjacent blade assembly occurs at the pivot corner 102. As the corners lie off-center of the axis of the rod 73, pivoting of the sections increases the axial length of the rod 73, and thereby also increases the tensile load on the rod 73. This increased tensile load also acts to increase the restoring force tending to return the head 10*c* to the flat orientation. This increase in the restoring force may be minimized by utilizing an arcuate pivot as illustrated in FIG. 8B, where an upper radius 108 of one blade assembly 15*f* contacts the lower radius 106 of an adjacent blade assembly. The length of the rod is not increased during pivoting, and the friction between the sliding surfaces of the upper radius 108 and the lower radius 106 reduces the liveliness of the spring action of the razor head. That is, as the razor head is bent by changing shaving forces, it does not snap back as suddenly, as the spring energy of the rod 73 is partially adsorbed by the friction inherent in the arcuate pivot contact. In FIG. 8C, the geometry of the pivoting area of the blade assemblies 15*g* produces a knife contact, minimizing both frictional energy absorption and stretching of the rod 73. The pivot 112 mates with the groove 118 on an adjacent blade assembly. The groove 118 is defined by the locating knuckles 116, and the pivot 112 is defined by the recesses 114. As shown, the pivoting takes place at a point equidistant between adjacent segments 15*g*, thereby eliminating the small "overbite" that would take place at the upper surface of the razor assembly 10*c* during concave bending. A small chamfer 110 on the upper surface of the blade assembly 15*g* can serve the same purpose, as well as eliminating the possibility of pinching of the skin during concave bending (as shown by the concave bend line 56 in FIG. 4).

Figure 9:
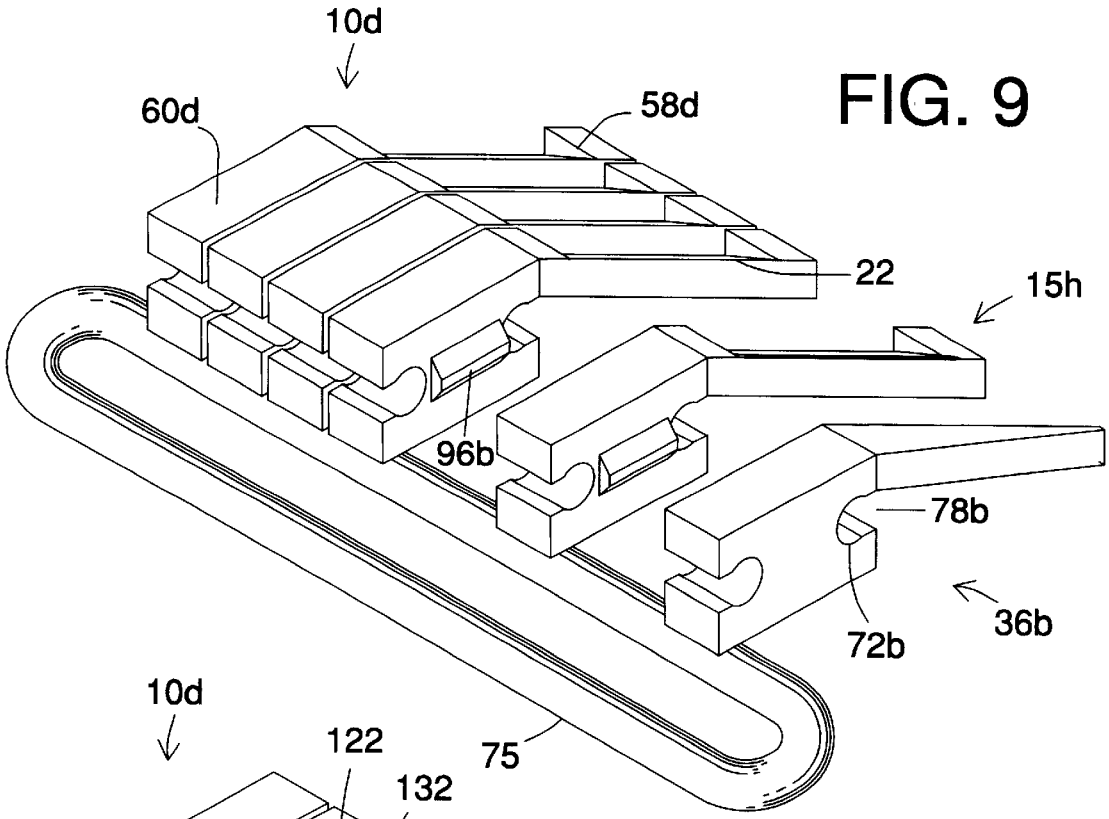
FIG. 9 is an exploded perspective view of a flexible razor head with separable segments.

In FIG. 9, a variation of a flexible razor head employing a ligature is shown in exploded form. A series of blade assemblies 15*h* with optional flanking guard 36*b* is shown in a pivotal relationship. Some of the blade assemblies 15*h* are omitted for illustrative clarity. The ligature 75 takes the form of a ring, which when stretched, can slip into the slots 78*b*, and thence into the channels 72*b*. Residual tension in the ligature 75 produces compressive forces between the blade assemblies 15*h*, keeping the razor head assembly 10*d* together, and also providing restoring forces to return the razor head assembly to a flat condition after being bent into convex or concave form by shaving forces. Pivots are formed between individual blade assemblies 15*h* by contact of rocker face 96*b* with corresponding rocker land (not shown). The same types of pivoting contacts may be employed as shown in FIGS. 8A, 8B and 8C.

Figure 10:
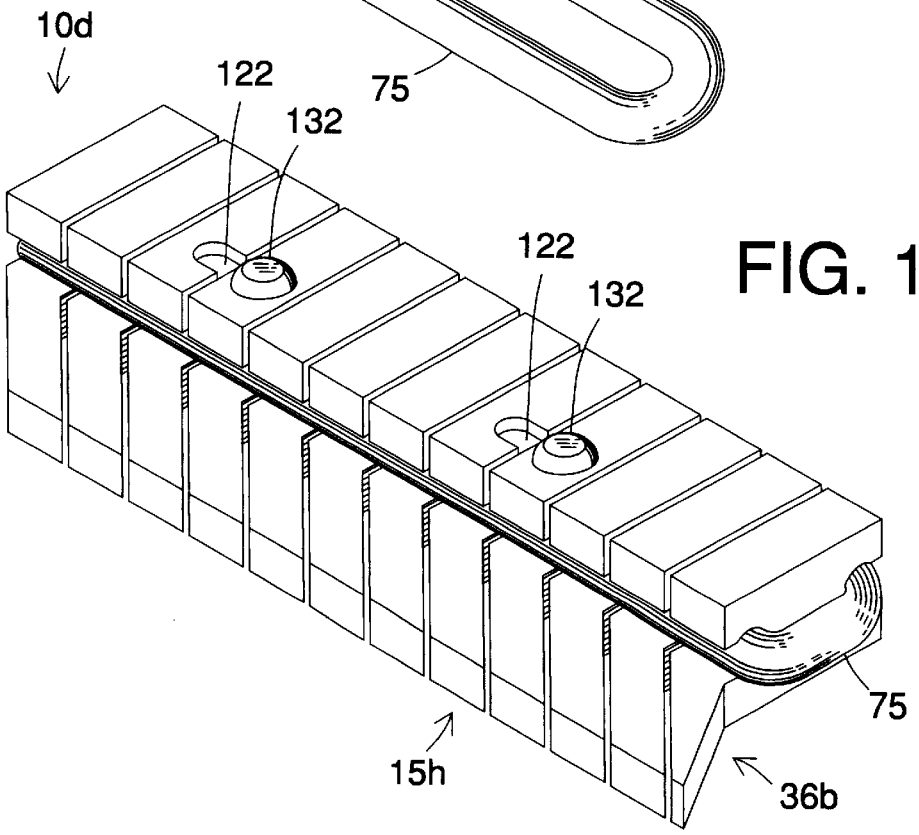
FIG. 10 is a perspective view of the rear mounting surface of the assembled razor head shown in FIG. 10.

One particular two point mounting suitable for use in the instant invention is illustrated in FIG. 10, which shows the assemble razor of FIG. 9 in an inverted orientation. Flat topped spherical buttons 132, fastened to the bottom of two razor assemblies 15*h*, serve as pivotable mounting points for magnetic supports. Asymmetrically placed recesses 122 serve as locating keys, to prevent the razor head 10*d* from being accidentally mounted in the reverse orientation.

Turning now to FIG. 11A, the razor head 10*c* is shown just prior to attachment with support assembly 82, which comprises the razor handle 12*b*, and the support housing 62 which carries the attachment mechanism. As shown in the figure, magnetically susceptible buttons 132 are in close proximity with magnetized cups 138, which have mating internal surfaces, and will be pulled into contact with the cups 138 by magnetic force. The cups 138 are pivotally trapped between the top bearing 124 and the lower bearing 126. The arrangement is more clearly shown in the enlarged sectional view of FIG. 11B, where the cup 138 is penetrated by a moveable pin 120 which, when forced down into contact with the button 132, overcomes the magnetic binding, and releases the razor head. While the above discussion refers to cups 138 carried by the mounting means and buttons 132 carried by the razor head, it is functionally immaterial whether the buttons or the cups are actually magnetized, as long as a magnetic force can be directed between them. For instance, a separate magnet (not shown) carried by the mounting means may induce magnetism in the cups, or the buttons 132 may be magnetized alone, or both cups 138 and buttons 132 may be magnetized.

In order to prevent the razor head from being mounted backwards, the mounting means may be made asymmetric, so that connection can be established in one orientation, and refused in all others. By way of example only, and not limitation, in FIG. 11B, pin 121 is shown to enter recess 122 when cup 138 contacts button 132. In any other orientation, pin 121 acts as a standoff, preventing docking of the attachment means. Other asymmetric means may be used to insure the correct attachment orientation, for instance, the left button and mating magnet may be of a different size or shape relative to the right button and mating magnet. As another method of asymmetric keying of the mounting means to the razor head, the buttons 132 may be magnetized with opposite polarities, mating with cups 138 with opposite polarities. As a non-limiting example, the left magnet may have a north pole mating with a south pole of the left button, while the right magnet has a south pole mating with a north pole of the right button, such that when the razor head is turned 180 degrees, the poles of the respective (magnetized) buttons and magnets repel one another, thereby preventing docking.

Turning to FIG. 12, the left side of the figure shows the razor head 10*c* attached to the support assembly 82, while the right side of the figure shows the razor head 10*c* being released from the support assembly 82. When the release button 80 is pressed down (80'), ejection bar 128 is moved down. The ejection cylinder 130 and the ejection pin 120 are connected to the ejection bar 128 by means of the post 134. Surrounding the ejection cylinder 130 is the spring 136, which has an initial compression. During ejection of the razor head 10*c*, the spring 136' is further compressed. The compression of the spring 136' against the top of the cup 138 serves as a restoring force not only to return the pin 120 to its starting position once the button 80' is released, but also to restore the cup 138 to a level position relative to the housing 62. The effects of shaving forces on the razor head 10*c* are illustrated in FIG. 13, where the razor head has been bent into a convex form, relative to the neutral shaving plane of the razor. The distance between the buttons 132 is decreased by this deformation of the razor head, and the cups 138' pivot inward to accommodate this motion, while the springs 136 load the inside upper edges of the cups 138', so as to produce a restorative moment on the cups 138'. The center of rotation of the button 132 relative to the cup 138 is offset below that of the center of rotation of the cup relative to the bearings 124, 126. This offset allows the rotation of the cups to compensate for the distance change between the buttons 132 during bending of the razor head 10*c*. While spherical surfaces for the mounting buttons 132 and mating surfaces of the cups 138 have been discussed herein, other surface geometries may be used. Spherical surfaces allow bending of the razor head about an axis parallel to the trim direction. Use of buttons and cups with cylindrical surfaces (not shown) with axes thereof parallel to the shaving direction will allow accommodation of the razor head to convex and concave bending while eliminating the bending about an axis parallel to the trim direction. Use of surfaces which are spherical in the plane of the convex and concave bending of the razor head, and elliptical or oval in the perpendicular direction (not shown), allow accommodation to convex and concave bending of the razor head while allowing a reduced amount of rotational motion about an axis parallel to the trim direction, as compared to surfaces that are fully spherical. While magnetic attachment means have been discussed above, other attachment means may also be used. As an example, purely mechanical means may be used, as taught by Chen (U.S. Pat. No. 5,182,858), and incorporated herein by reference.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims.

I claim:

1. A flexible safety razor head having a shaving direction and a trim direction, comprising:

(a) a plurality of segments oriented in a single linear array along the trim direction;

(b) cutting edge means having a cutting edge length of less than 8 mm and oriented at a slicing angle of more than 30 degrees, cantilever mounted to a plurality of said segments;

(c) at least one leading guard segment for each said cutting edge means;

(d) at least one trailing guard segment for each said cutting edge means; and (e) flexible connecting means disposed between adjacent said segments;

whereby the safety razor head is capable of bending to follow complex skin geometry, while the flow of shaving debris and shaving lubricant is enhanced between said cantilever mounted cutting means.

2. A flexible safety razor head having a detachable handle, comprising:

(a) a plurality of segments oriented in a single linear array along the trim direction;

(b) flexible connecting means disposed between adjacent said segments;

(c) at least two magnetic attachment points on the handle; and (d) magnetically susceptible means fastened to the razor head for pivotally mating with said magnetic attachment points;

whereby the safety razor head is capable of convex and concave bending in response to shaving forces.

3. A safety razor head as recited in claim 1, further comprising:

(a) a handle; and (b) means for connecting the razor head to said handle;

so that forces are developed in reaction to shaving forces to bend the razor head into convex or concave form about an axis parallel to the shaving direction.

4. A safety razor head as recited in claim 3, wherein said means for connecting the razor head to said handle comprises magnetized mating elements.

5. A safety razor head as recited in claim 3, wherein said means for connecting the razor head to said handle comprises two attachment points located a distance from the distal ends of the razor head equal to between 5% and 40% of the width of the razor head, where said width is measured in the trim direction.

6. A safety razor head as recited in claim 1, wherein said connecting means between segments comprises bridges connecting adjacent segments.

7. A safety razor head as recited in claim 6, comprising at least one upper bridge and at least one lower bridge.

8. A safety razor head as recited in claim 1, wherein the segments are bound together in an articulated relationship by ligature means.

9. A safety razor head as recited in claim 8, wherein said ligature means is under tension.

10. A safety razor head as recited in claim 8, wherein said ligature means comprises an elastic rod.

11. A safety razor head as recited in claim 8, wherein said ligature means comprises an elastic ring.

12. A flexible safety razor having a detachable handle as recited in claim 2, further comprising means for simultaneously urging said magnetically susceptible means out of contact with said magnetic attachment points, whereby the razor head may be easily detached from the handle.

13. A flexible safety razor having a detachable handle as recited in claim 2, wherein said magnetic attachment points comprises spherical surfaces.

14. A flexible safety razor having a detachable handle as recited in claim 13, wherein said magnetically susceptible means comprises spherical surfaces for mating with said attachment points.

15. A flexible safety razor having a detachable handle as recited in claim 2, wherein said magnetic attachment points comprises cylindrical surfaces.

16. A flexible safety razor having a detachable handle as recited in claim 15, wherein said magnetically susceptible means comprises cylindrical surfaces for mating with said attachment points.

17. A flexible safety razor having a detachable handle as recited in claim 2, wherein said magnetic attachment points comprises ellipsoidal surfaces.

18. A flexible safety razor having a detachable handle as recited in claim 17, wherein said magnetically susceptible means comprises ellipsoidal surfaces for mating with said attachment points.

19. A flexible safety razor having a detachable handle as recited in claim 2, further comprising asymmetric key means, whereby docking of the handle with the razor head in an incorrect orientation is prevented.

* * * * *